US012018487B2

(12) United States Patent
Rasmussen

(10) Patent No.: US 12,018,487 B2
(45) Date of Patent: Jun. 25, 2024

(54) WALL PANEL APPARATUS

(71) Applicant: Corey S Rasmussen, Ormond Beach, FL (US)

(72) Inventor: Corey S Rasmussen, Ormond Beach, FL (US)

( * ) Notice: Subject to any disclaimer, the term of this patent is extended or adjusted under 35 U.S.C. 154(b) by 205 days.

(21) Appl. No.: 17/565,364

(22) Filed: Dec. 29, 2021

(65) Prior Publication Data

US 2022/0220736 A1 Jul. 14, 2022

Related U.S. Application Data

(60) Provisional application No. 63/106,887, filed on Oct. 29, 2020.

(51) Int. Cl.

| | |
|---|---|
| ***E04B 2/00*** | (2006.01) |
| ***E04B 1/76*** | (2006.01) |
| ***E04B 2/60*** | (2006.01) |
| ***E04C 2/26*** | (2006.01) |
| ***E04C 2/288*** | (2006.01) |
| ***E04C 2/38*** | (2006.01) |
| ***E04C 2/52*** | (2006.01) |
| *E04C 2/00* | (2006.01) |

(52) U.S. Cl.

CPC ..... *E04C 2/2885* (2013.01); *E04B 2/60* (2013.01); *E04C 2/382* (2013.01); *E04C 2/384* (2013.01); *E04C 2/46* (2013.01); *E04C 2/526* (2013.01); *E04C 2002/004* (2013.01)

(58) Field of Classification Search

CPC ..... E04B 2/60; E04C 2/2885; E04C 2/382; E04C 2/384; E04C 2/46; E04C 2/526; E04C 2/60; E04C 2002/004

USPC ..... 52/309.9

See application file for complete search history.

(56) References Cited

U.S. PATENT DOCUMENTS 3,274,741 A * 9/1966 Neagle ..... E04B 2/78 52/309.1
3,292,331 A * 12/1966 Sams ..... E04B 2/10 52/439
3,538,660 A * 11/1970 Moor ..... E04B 2/821 52/285.3
3,828,502 A * 8/1974 Carlsson ..... E04B 1/6145 52/125.4

(Continued)

*Primary Examiner* — James J Buckle, Jr.
(74) *Attorney, Agent, or Firm* — Barry Choobin; Patent 360

(57) ABSTRACT

A building apparatus for a residential or commercial building that includes a prefabricated wall panel and a horizontal beam mounted on a top of the prefabricated wall panel. The prefabricated wall panel includes a first concrete block, a second concrete block, and an insulation panel sandwiched between the two concrete blocks. A plurality of spaced-apart hollow tubes extend between the top side and the bottom side of the prefabricated wall panel and each tube has a flange at its a periphery. The tubes reinforce the first concrete block, and the flanges are supported on the top side of the wall. The horizontal beam is fastened to these flanges. The prefabricated wall panel further includes a U-shape beam that extends from the top side to the bottom side and is positioned at or near the left side or the right side of the prefabricated wall panel. A plurality of slings spaced apart run along a length of the U-shape beam and can provide for assembling two wall panels.

20 Claims, 8 Drawing Sheets

(56) References Cited

U.S. PATENT DOCUMENTS

| | | | | | |
|---|---|---|---|---|---|
| 4,154,030 | A * | 5/1979 | Huguet | E04B 1/6158 | 52/98 |
| 4,567,699 | A * | 2/1986 | McClellan | E04B 2/7401 | 52/782.1 |
| 4,862,660 | A * | 9/1989 | Raymond | F24F 13/20 | 52/404.3 |
| 5,209,035 | A * | 5/1993 | Hodges | E04B 2/7425 | 52/239 |
| 5,279,089 | A * | 1/1994 | Gulur | E04C 2/205 | 52/794.1 |
| 5,371,990 | A * | 12/1994 | SalahUddin | E04B 1/163 | 52/379 |
| 5,519,971 | A * | 5/1996 | Ramirez | E04C 2/288 | 52/586.1 |
| 5,657,606 | A * | 8/1997 | Ressel | E04C 3/08 | 52/690 |
| 7,185,467 | B2 * | 3/2007 | Marty | E04B 1/165 | 52/745.1 |
| 8,151,539 | B2 * | 4/2012 | Grinsted | E04C 2/205 | 52/745.1 |
| 10,870,990 | B1 * | 12/2020 | Mueller | H02G 3/22 | |
| 11,718,984 | B2 * | 8/2023 | Tiramani | B32B 15/18 | 52/79.5 |
| 11,739,547 | B2 * | 8/2023 | Tiramani | E04B 7/22 | 52/79.9 |
| 2017/0121976 | A1 * | 5/2017 | Neumayr | E04C 2/324 | |
| 2018/0038103 | A1 * | 2/2018 | Neumayr | E04C 2/46 | |
| 2020/0299962 | A1 * | 9/2020 | Espinosa | B32B 3/08 | |

* cited by examiner

WALL PANEL APPARATUS

CROSS-REFERENCE TO RELATED APPLICATIONS

This application claims priority from the U.S. provisional patent application Ser. No. 63/106,887, filed on Oct. 29, 2020, which is incorporated herein by reference in its entirety.

FIELD OF INVENTION

The present invention relates to a prefabricated wall panel apparatus, and more particularly, the present invention relates to a prefabricated wall panel apparatus and assembling the prefabricated wall panels to erect a building.

BACKGROUND

Prefabricated wall panels are known in the art for erecting a building in a short time and at a low construction cost. The prefabricated wall panels can be constructed offsite in an industrial setting and finished wall panels can be transported to the construction site. The prefabricated wall panels can be assembled at the construction site to erect a building. The prefabricated wall panels have certain advantages over constructing a wall onsite. The primary advantage is that the insulation in the prefabricated wall panels can be efficiently made under an industrial setting. Secondly, the labor hours and human errors can be significantly reduced.

Typical prefabricated wall panels can include concrete blocks, an insulation panel sandwiched between the concrete blocks and further reinforced by steel rebars and mesh wire. The steel rebars can also provide for interlocking the two adjacent prefabricated wall panels.

An industrial need is always there for improving the existing technologies to be more economical or efficient or less laborious.

SUMMARY OF THE INVENTION

The following presents a simplified summary of one or more embodiments of the present invention to provide a basic understanding of such embodiments. This summary is not an extensive overview of all contemplated embodiments and is intended to neither identify critical elements of all embodiments nor delineate the scope of any or all embodiments. Its sole purpose is to present some concepts of one or more embodiments in a simplified form as a prelude to the more detailed description that is presented later.

The principal object of the present invention is therefore directed to a prefabricated wall panel apparatus that allows erecting a building in less time, more efficiently, and with less labor.

It is another object of the present invention to increase the factory-based assembly and reduce the onsite work.

It is still another object of the present invention to reduce construction costs.

It is yet another object of the present invention to improve construction quality.

In one aspect, disclosed is a building apparatus for a residential or commercial building, the building apparatus comprises a prefabricated wall panel having a top side, a bottom side, a left side, and a right side. The prefabricated wall panel comprises a plurality of spaced-apart hollow tubes that extend between the top side and the bottom side of the prefabricated wall panel, each tube of the plurality of spaced-apart hollow tubes has a flange that extends perpendicularly from a periphery of the each tube, wherein the flange rests upon the top side of the prefabricated wall panel. The flange is welded to the periphery of the each tube, the plurality of spaced-apart hollow tubes configured to receive a plurality of rebars. The prefabricated wall panel further comprises a U-shape beam that extends from the top side to the bottom side and is positioned at or near the left side or the right side of the prefabricated wall panel, the U-shape beam has a base plate and two continuous and upstanding plates forming a U-shape, an inner surface of the U-shape beam is exposed. The prefabricated wall panel further comprises a plurality of slings fastened to the base plate of the U-shape beam, the plurality of slings are spaced apart at regular intervals along a length of the U-shape beam. The building apparatus further comprises: a horizontal beam mounted on the top side of the prefabricated wall panel, the horizontal beam has a top plate and a bottom plate, the bottom plate configured to be welded to the flange of each of the plurality of spaced-apart hollow tubes. The horizontal beam further comprises a plurality of bores that extend between the top plate and the bottom plate, wherein the plurality of bores are coaxially aligned to the plurality of spaced-apart hollow tubes. The prefabricated wall panel further comprises a first concrete block; a second concrete block; an insulation panel, wherein the insulation panel is sandwiched between the first concrete block and the second concrete block; and a plurality of U-shape connectors that extends perpendicularly between the first concrete block and the second concrete block, the plurality of U-shape connectors are configured to immobilize the insulation panel mounted over the second concrete block.

In one implementation, the prefabricated wall panel further comprises a rebar mesh that extends throughout the first concrete block and the second concrete block. The prefabricated wall panel further comprise a plurality of rebar truss to reinforce the first concrete block. The prefabricated wall panel further comprises one or more electrical receptacles configured in the first concrete block; and one or more conduits that extend from the one or more electrical receptacles within the first concrete block and open at the top side, wherein the one or more conduits are configured to allow electrical wires to pass through. The one or more electrical receptacles comprise light switches.

In one aspect, disclosed is a method for constructing a residential or a commercial building, the method comprising the steps of providing a prefabricated wall panel having a top side, a bottom side, a left side, and a right side. The prefabricated wall panel comprises a first concrete block, a second concrete block, an insulation panel, wherein the insulation panel is sandwiched between the first concrete block and the second concrete block, a plurality of U-shape connectors that extends perpendicularly between the first concrete block and the second concrete block, the plurality of U-shape connectors are configured to immobilize the insulation panel, and a plurality of spaced-apart hollow tubes that extend between the top side and the bottom side of the prefabricated wall panel, each tube of the plurality of spaced-apart hollow tubes has a flange that extends perpendicularly from a periphery of the each tube, wherein the flange rests upon the top side of the prefabricated wall panel, the plurality of spaced-apart hollow tubes configured to receive a plurality of rebars. The prefabricated wall panel further comprises a U-shape beam that extends from the top side to the bottom side and is positioned at or near the left side or the right side of the prefabricated wall panel, the U-shape beam has a base plate and two continuous and upstanding plates forming a U-shape, an inner surface of the U-shape beam is exposed, and a plurality of slings fastened to the base plate of the U-shape beam, the plurality of slings are spaced apart at regular intervals along a length of the U-shape beam.

In one implementation, the method further comprises the steps of brining the prefabricated wall panel close to an another prefabricated wall panel, such that the U-shape beam of the prefabricated wall panel and a U-shape beam of the another prefabricated wall panel forms an enclosed volume and the plurality of slings of the prefabricated wall panel and a plurality of slings of the another prefabricated wall panel overlap one above another; inserting a rebar into the plurality of slings of the prefabricated wall panel and the plurality of slings of the another prefabricated wall panel; and upon inserting the rebar, filling concrete into the enclosed volume. The method further comprises the steps of providing a horizontal beam, the horizontal beam comprises: a top plate and a bottom plate, the bottom plate configured to be welded to the flange of the each tube of the plurality of spaced-apart hollow tubes, and a plurality of bores that extends through the horizontal beam between the top plate and the bottom plate, wherein the plurality of bores are coaxially aligned to the plurality of spaced-apart hollow tubes, wherein the method further comprises the steps of mounting the horizontal beam on the top side of the prefabricated wall panel; upon mounting, mounting a ceiling panel upon the horizontal beam; and inserting a plurality of rebars through a plurality of bores in the ceiling panel into the plurality of bores of the horizontal beam and the plurality of spaced-apart hollow tubes of the prefabricated wall panel.

BRIEF DESCRIPTION OF THE DRAWINGS

The accompanying figures, which are incorporated herein, form part of the specification and illustrate embodiments of the present invention. Together with the description, the figures further explain the principles of the present invention and enable a person skilled in the relevant arts to make and use the invention.

DETAILED DESCRIPTION

Subject matter will now be described more fully hereinafter with reference to the accompanying drawings, which form a part hereof, and which show, by way of illustration, specific exemplary embodiments. Subject matter may, however, be embodied in a variety of different forms and, therefore, covered or claimed subject matter is intended to be construed as not being limited to any exemplary embodiments set forth herein; exemplary embodiments are provided merely to be illustrative. Likewise, the reasonably broad scope for claimed or covered subject matter is intended. Among other things, for example, the subject matter may be embodied as methods, devices, components, or systems. The following detailed description is, therefore, not intended to be taken in a limiting sense.

The word "exemplary" is used herein to mean "serving as an example, instance, or illustration." Any embodiment described herein as "exemplary" is not necessarily to be construed as preferred or advantageous over other embodiments. Likewise, the term "embodiments of the present invention" does not require that all embodiments of the invention include the discussed feature, advantage, or mode of operation.

The terminology used herein is to describe particular embodiments only and is not intended to be limiting of embodiments of the invention. As used herein, the singular forms "a", "an", and "the" are intended to include the plural forms as well, unless the context indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The following detailed description includes the best currently contemplated mode or modes of carrying out exemplary embodiments of the invention. The description is not to be taken in a limiting sense but is made merely to illustrate the general principles of the invention since the scope of the invention will be best defined by the allowed claims of any resulting patent.

Figure 1:
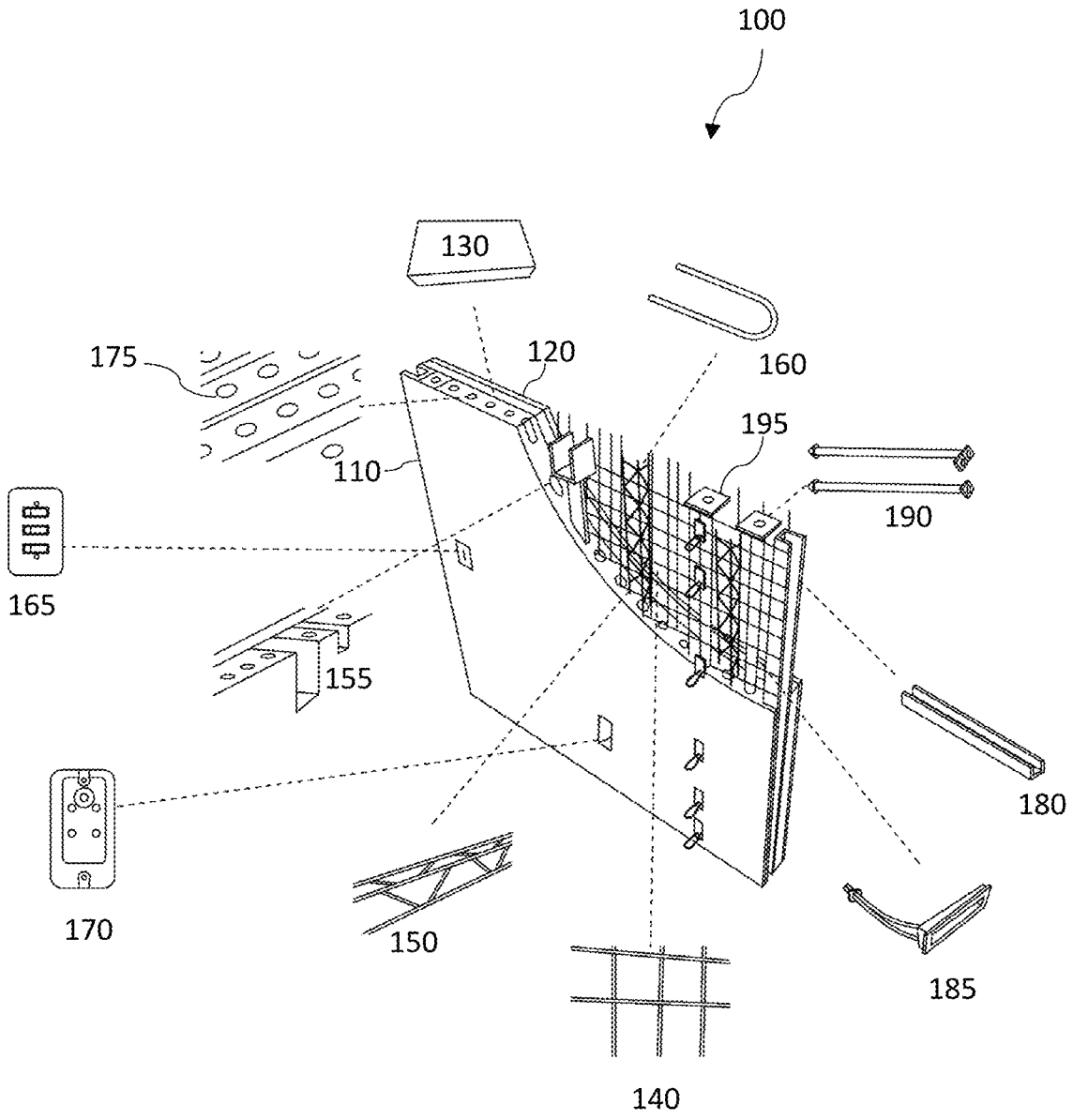
FIG. 1 shows a prefabricated wall panel, according to an exemplary embodiment of the present invention.

Referring to FIG. 1 which shows a perspective view of a prefabricated wall panel 100 according to an exemplary embodiment of the present invention. The disclosed prefabricated wall panel 100 can be made from concrete and reinforced using metal mesh and thick steel rebars. FIG. 1 shows the prefabricated wall panel 100 has two concrete blocks, a front concrete block 110 and a rear concrete block 120, and an insulation layer 130 sandwiched between the two concrete blocks. A section of the prefabricated wall panel is shown without concrete to illustrate the different components within the front concrete block. The thickness of the two concrete blocks can be varied and usually, one concrete block can be thicker than the second concrete block. The thinner concrete side can face outside the building and one or more suitable coatings can be applied to the thinner concrete block, for example, a stone veneer can be applied on the outer surface of the thinner concrete block. The rear concrete block 120 in FIG. 1 is the thinner concrete block.

A rebar mesh 140 can be seen embedded throughout an area of the front concrete block 110, wherein the rebar mesh 140 can provide for reinforcing the structure. The rebar mesh 140 can include metal wires arranged in a grid-like fashion such that a square void is formed between the interlocking metal wires. In one implementation, a 4 mm steel wire can be used for the rebar mesh 140 with square voids throughout.

The strength of the structure can be further enhanced by rebar truss 150. The rebar truss 150 can be used to reinforce the wall panel and can be disposed around doors and windows and sides for added strength. The reinforcement of the concrete wall panels using the rebar mesh and rebar truss are known in the art and hence not further described herein. Also, the thickness of the two concrete blocks and the sandwiched insulation layer can be varied without departing from the scope of the present invention. In one implementation C30 concrete can be used for the two concrete blocks, the C30 concrete is known in the art. Also, disclosed is a method for reinforcing the insulation panel by using metal U-type connectors 160 for fastening the two concrete blocks and the insulation panel. The insulation panel can be extruded polystyrene insulation (XPS) panels commercially available, such as from OWENS CORNING®. It is understood, however, that any wall insulation panel known to a skilled person for use in precast wall panels can be used without departing from the scope of the present invention. The insulation panel, also known as an insulation board, can act as a sound barrier, heat barrier, and can also prevent moisture seeping into the walls from outside. Additionally, the exposed surface of the thinner concrete block that faces outside of the building can be treated with waterproof coatings.

FIG. 1 also shows a switch box 165 and an electrical functional box 170 built into the wall panel 100. The switch box and the electrical functional box can be supported by the rebar mesh or rebar truss, and then the concrete can be filled into the front concrete block. The switch box and the electrical functional box can be any standard electrical components known and approved for use in a residential and commercial building. The location of the switch box and the electrical functional box can be predetermined and accordingly positioned in the wall panel. The provision of the built-in switch box and the electrical functional box offers a great advantage preventing later cutting off the wall to make room for the switch and electrical boxes that is messy, laborious, time-consuming, and increase the overall construction cost. Suitable conduits and extruded holes 175 can also be provided in the front concrete block 110 for electrical wires and plumbing that has to travel through the wall. The switch and electrical boxes can have connected conduits that open at the top of the wall panel and can be used for passing the electrical wires. FIG. 1 shows a single switch and electrical box; however, it is understood that more than one switch and one electrical box can be provided without departing from the scope of the present invention. The unused extruded holes can be filled with concrete at the job site.

On the left side and the right side of the wall panel 100 can be seen a U-shape beam 180 that extends from top to bottom of the first concrete block 110. The U-shape beam 180 can be made from a planar sheet that can be folded twice at a spaced-apart distance to form a three-sided or substantially U-shape beam. The U-shape beam 180 can be provided at the ends or near the ends of the wall panel for interlocking one wall panel to another wall panel while assembling the wall panels at the job site. The position of the U-shape beam 180 in a wall panel can depend upon the position and angle at which the two wall panels must be coupled. Steel slings 185 can also be provided along a length of the U-shape beam 180 at regular intervals to reinforce a joint between the two adjacent wall panels. The slings 185 can be fastened to a base of the U-shape beam 180 and extends outwards and away from the wall panel and in between the two plates of the U-shaped beam 180. In use, the two wall panels that have to be assembled can be bought close to each other such that the slings 185 of the two wall panels are one above the other and the two U-shaped beam 180 of the two wall panels can form an enclosed volume. Thick rebar can be inserted which passes through the overlapping slings of the two wall panels. Once the rebar is through, concrete can then be poured into the enclosed volume to join the two wall panels. It is understood that the slings can be provided on other portions of the front concrete block, as shown in FIG. 1. The slings can be loop-shaped and fastened to the U-shape beam, the rebar, and/or rebar mesh. The loop-shaped slings can be replaced by U-shape brackets, and such U-shape brackets are within the scope of the present invention. Also, shown in FIG. 1 are the connectors for steel girders.

Also, it can be seen in FIG. 1 are the tubes 190 run top to bottom at regularly spaced intervals. The tubes 190 can be hollow and made from a durable material that can provide additional reinforcement to the prefabricated wall panel 100. In one implementation, the tubes can be made of steel with an outer diameter of about 40 mm and the two tubes in the prefabricated wall panel can be spaced about 900 mm from each other. On top of the tube can be seen a flange 195 extending perpendicular from a periphery of the tube. The flange can be welded to the periphery of the tube and can rest upon the top side of the wall panel. Additionally, the flange can be fastened into the concrete of the wall panel using suitable fasteners. The flange can also be made from a durable material, such as steel. These flanges can provide support for the horizontal beams that are mounted on the top of the wall panels.

The horizontal beams can be mounted on the top of the wall panels and run along the length of the wall panels. The horizontal beams can allow mounting a ceiling on the top of the assembled wall panels.

Figure 2:
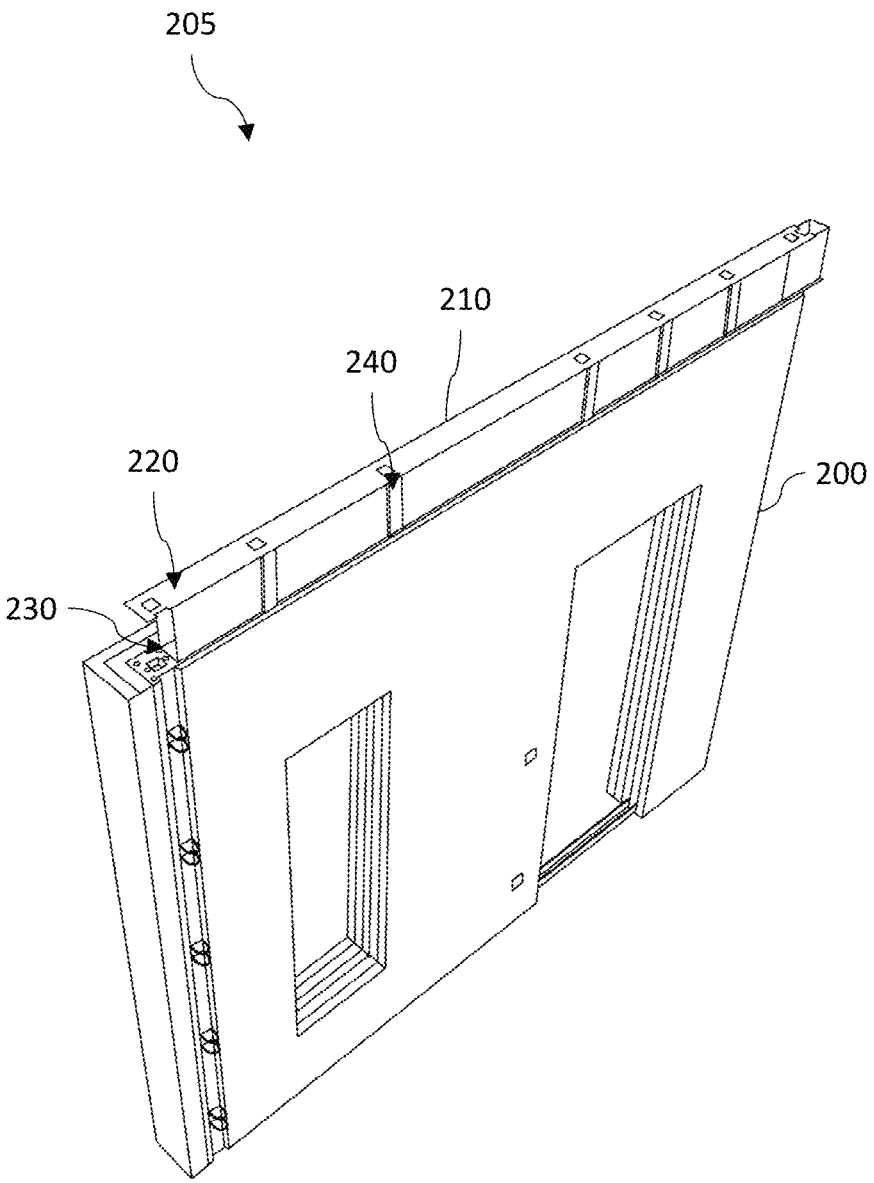
FIG. 2 shows a prefabricated wall panel apparatus, according to an exemplary embodiment of the present invention.

Referring to FIG. 2 which shows a prefabricate wall panel apparatus 205 having the prefabricated wall panel 200 and a horizontal beam 210 mounted on the top of the prefabricated wall panel 200. The horizontal beam 210 can include a top plate 220 and a bottom plate 230 those could be parallel to each other. The bottom plate of the horizontal beam can rest upon the top of the wall panel 200 and can be welded to the several flanges of the tubes disposed in the wall panel 200. Additionally, the steel plates can be used to join the horizontal beam to the wall panel or the two wall panels, wherein the steel plates can be of a rectangular shape, T-shape, or an L-shape.

The horizontal beam 210 can have several spaced apart bores 240 of a square shape therethrough between the top plate and the bottom plate. The space between the two adjacent bores of the horizontal beam can be equal to the space between the two adjacent tubes in the wall panel. In use, when the horizontal beam is mounted on the top of the wall panel such that the bottom plate of the horizontal beam rests upon the top of the wall panel, the horizontal beam can be positioned so that the bores of the horizontal beam can be coaxially aligned with the bores in the tubes of the wall panel. A ceiling panel can be mounted on the horizontal beams of the assembled wall panels, and the ceiling panel can also have bores through which rebars can be inserted, wherein the rebars can passthrough the bores of the horizontal beams into the tubes or extruded holes of the assembled wall panels. The bores in the horizontal beam can be square shape or cylindrical, FIG. 2 shows square shape bores.

Figure 3:
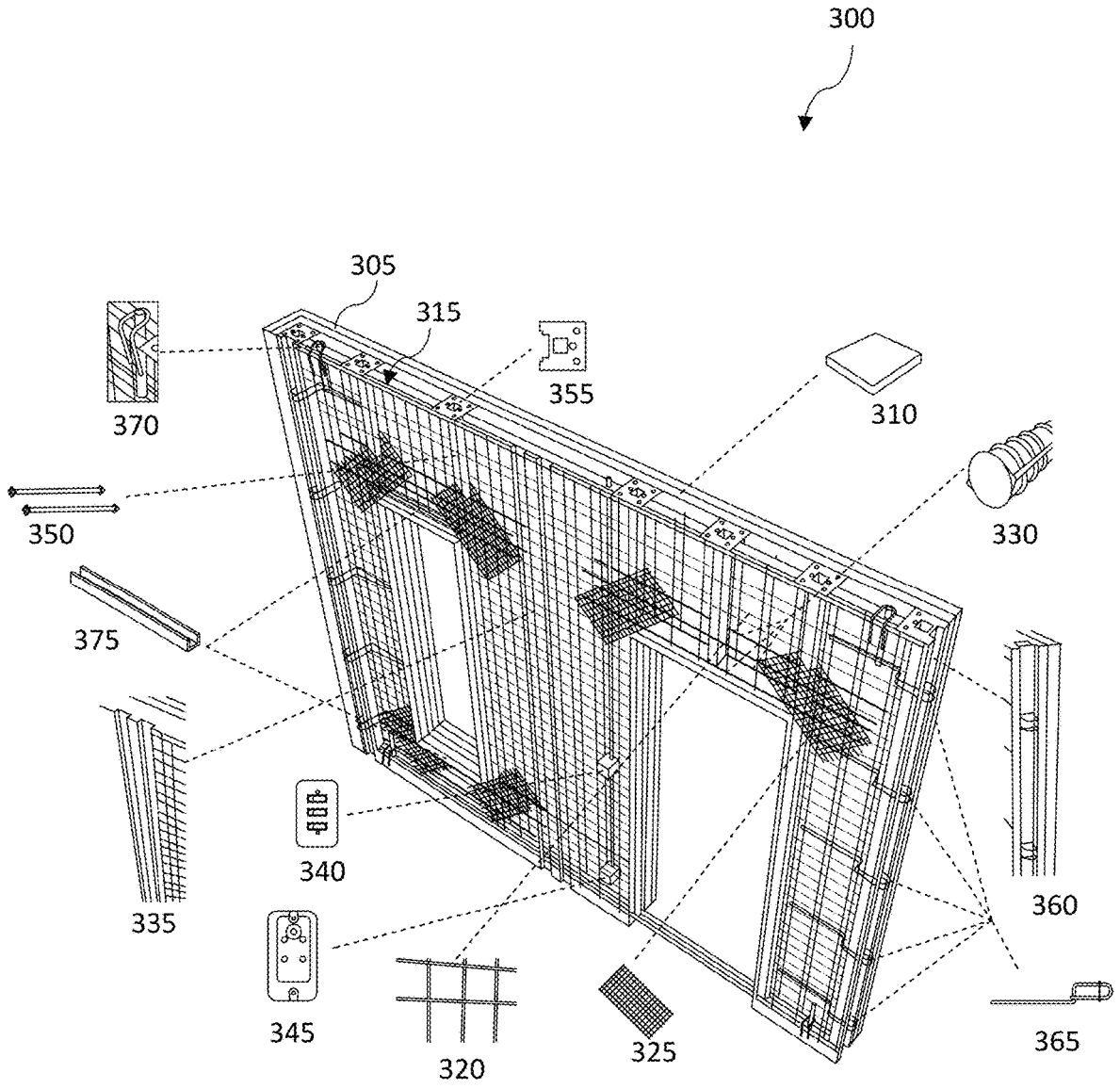
FIG. 3 shows the prefabricated wall panel apparatus shown in FIG. 2 without the horizontal beam and without concrete in a front concrete block to illustrate the components, according to an exemplary embodiment of the present invention.
Figure 4:
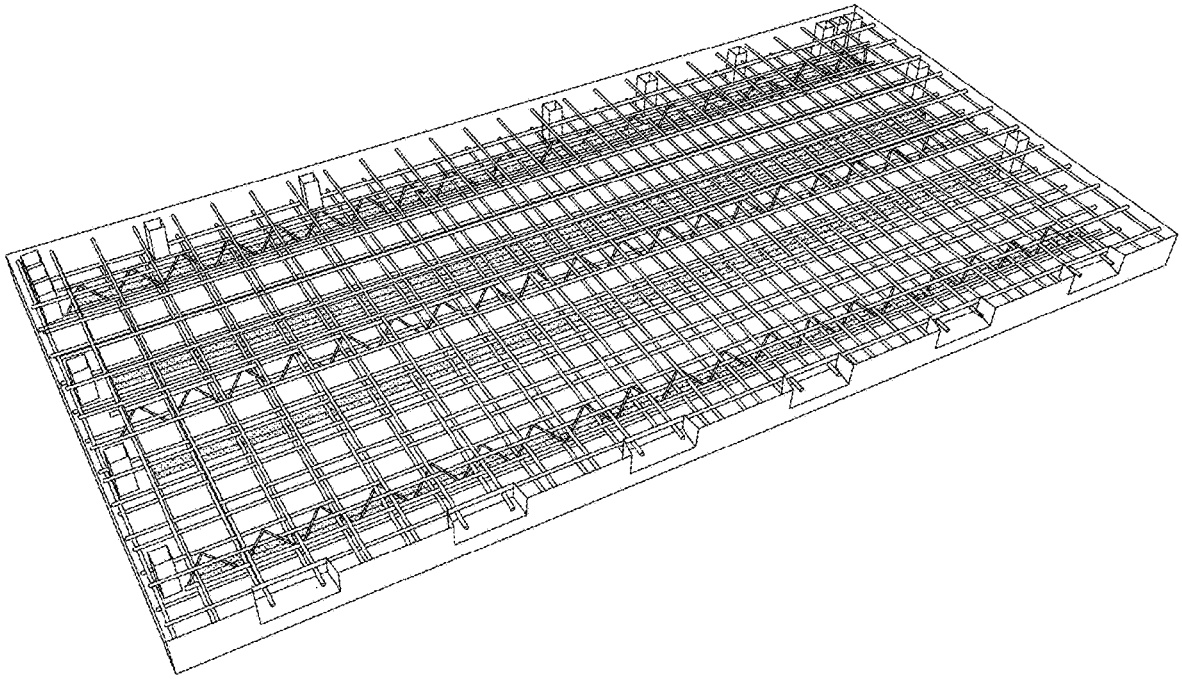
FIG. 4 shows a customized floor foundation that locks the walls, according to an exemplary embodiment of the present invention.
Figure 5:
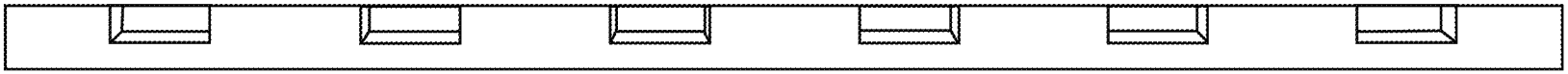
FIG. 5 is a side view of the customized floor foundation shown in FIG. 4, according to an exemplary embodiment of the present invention.
Figure 6:
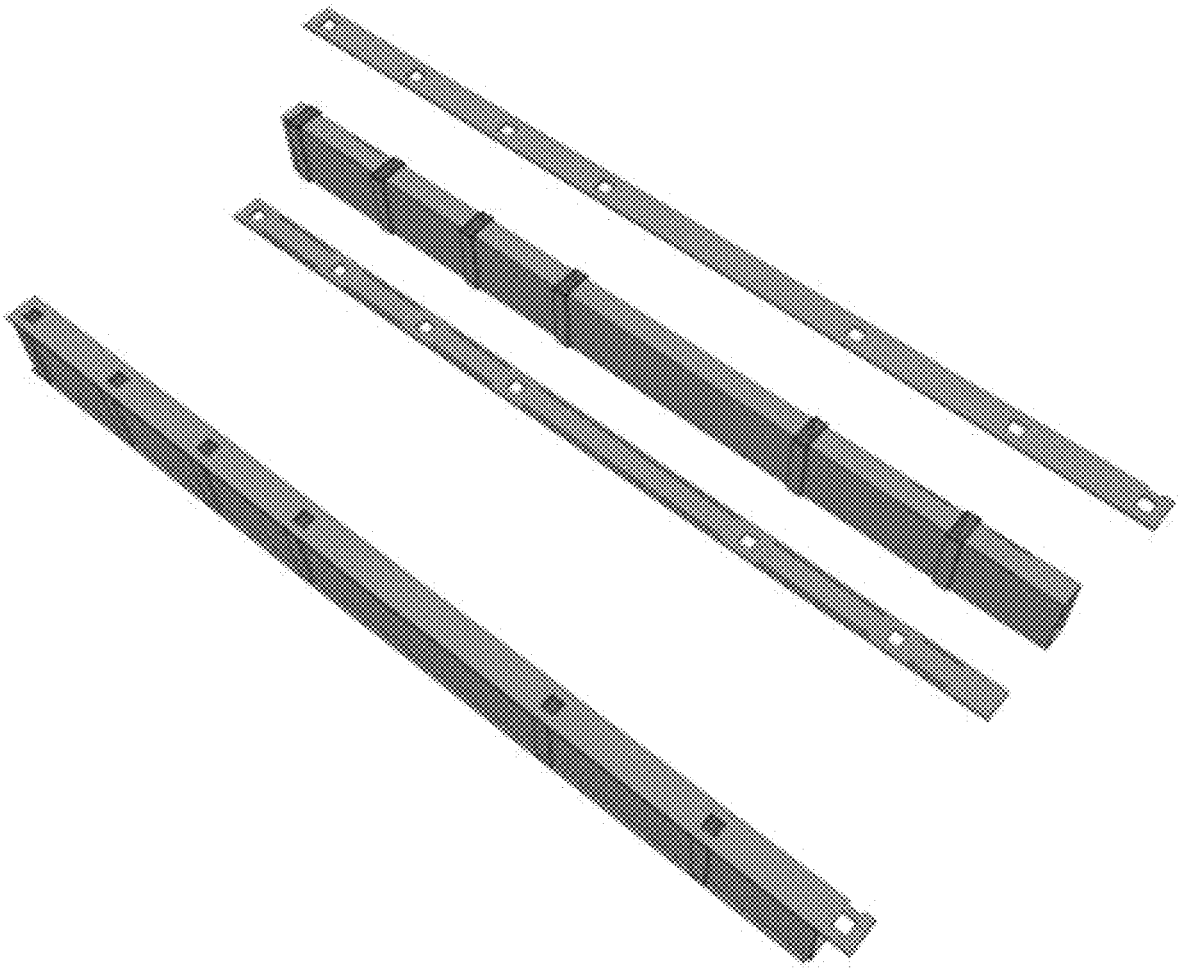
FIG. 6 shows a horizontal beam and an exploded view of the horizontal beam, the horizontal beam raises the customized floor foundation for HVAC and secures the corners, T's, and straightway securely, according to an exemplary embodiment of the present invention.
Figure 7:
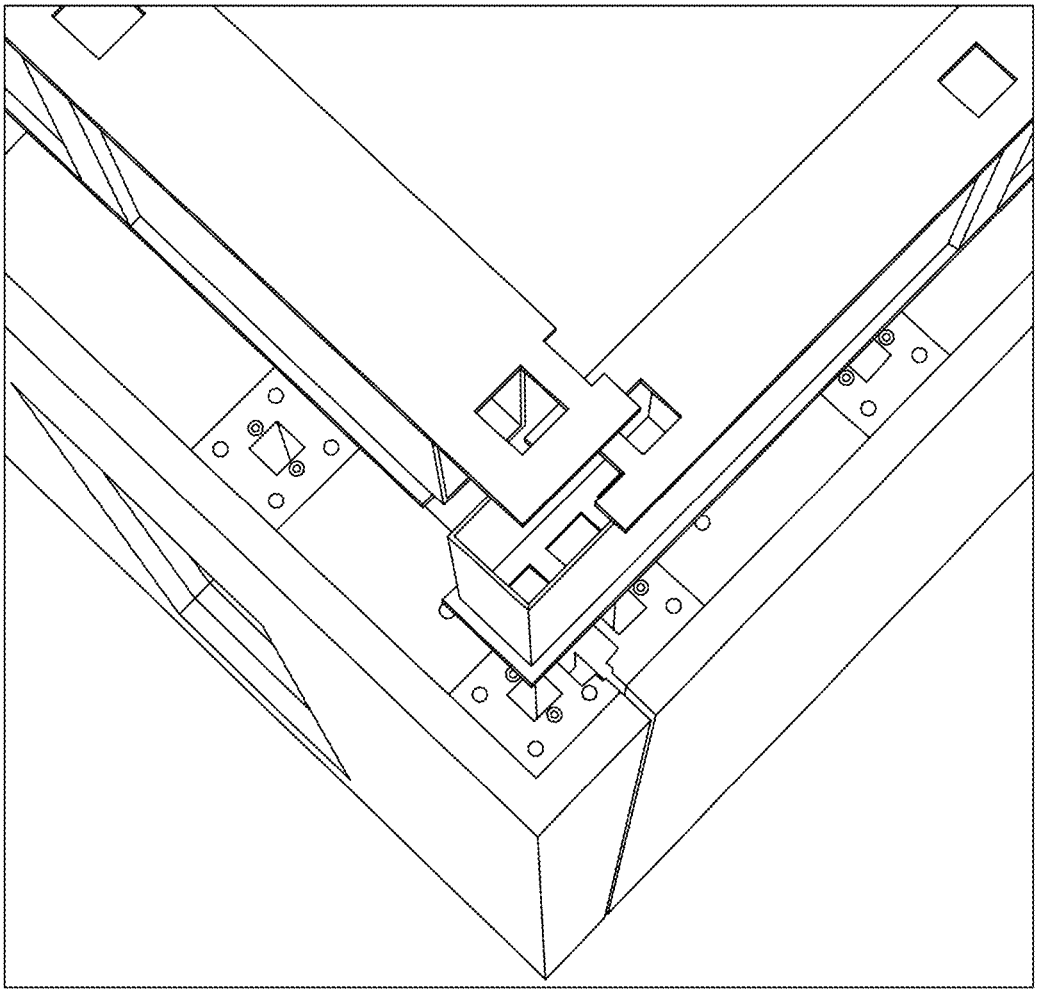
FIG. 7 shows the assembling of two walls and two horizontal beams, the horizontal beams allow to better lock the two walls together, according to an exemplary embodiment of the present invention.
Figure 8:
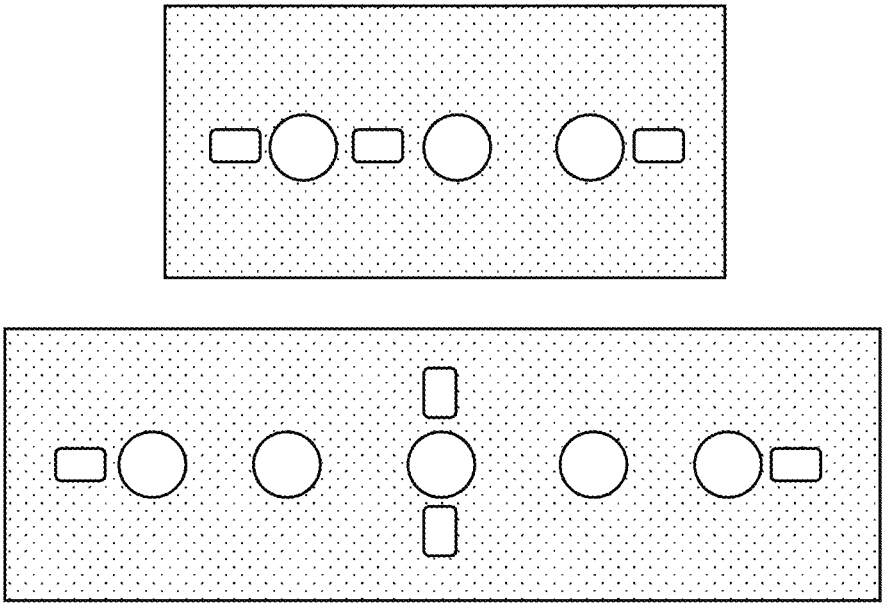
FIG. 8 shows the steel brackets that can be bolt to the top of a wall to secure it, according to an exemplary embodiment of the present invention.

Referring to FIG. 3 which shows the prefabricated wall panel 300 of the disclosed prefabricated wall panel apparatus as shown in FIG. 2 but without the horizontal beam. The disclosed prefabricated wall panel 300 may differ from the prefabricated wall panel 100 shown in FIG. 1 by omitting a few features such as the extruded holes, girders, and U-shape beam. In a preferred embodiment, the prefabricated wall panel 300 can include a rear concrete block 305, an insulation panel 310, and a front concrete panel 315, the structure and functioning of the three has been described for the prefabricated wall panel 100 and hence not repeated here. The disclosed prefabricated wall panel 300 can also include wire mesh bar 320 that has been previously described for the prefabricated wall panel 100. Wire mesh 325 can also be seen in FIG. 3 that is typically dense wire mesh and can be used around doors and windows for added strength. The prefabricated wall panel 300 can further include steel rebars 330 for reinforcement and structural support. Steel rebars of a diameter of about 12-16 mm can be used, and more preferably, of about 16 mm can be used such that a building can easily withstand hurricanes, earthquakes, and the like natural disasters. The prefabricated wall panel 300 can further include a U-shape or rectangular or square grooves 335 in the front concrete block for the water pipes to run up the wall. The prefabricated wall panel 300 can further include electrical switches 340 and electrical functional boxes 345 both have been described for the prefabricated wall panel 100 and hence not repeated here. Tubes 350 can also be seen in FIG. 3 that has been previously described for the prefabricated wall panel 100 in FIG. 1. The tubes 350 can be hollow and shown to be of square in shape. The steel tubes 350 can provide for additional reinforcement. Also, these tubes 350 can act as a support for mounting other elements, such as the horizontal beam. The flange 355 at a periphery of a square shape aperture can be welded to a periphery of the tube 350 and the flange can also include fasteners for anchoring to the concrete block, also described for the prefabricated wall panel 100 and not repeated here.

The prefabricated wall panel 300 can also include another U-shaped concrete molded U-beam 360 that can be stronger and better than using a metal U-shaped beam 180 in FIG. 1. The concrete molded U-beam can be molded at the time of manufacturing. A rigid double steel sling 365 can also be seen in FIG. 3 that extends from the U-shaped concrete molded U-beam 360. As described for the prefabricated wall panel 100, the U-shaped concrete molded U-beam 360 and the rigid double steel sling 365 can be used for joining two prefabricated wall panels, and the process is not repeated here. The rigid double steel sling 365 in comparison to the slings 185 shown in FIG. 1 can provide better strength and functionality. As shown in FIG. 3, a loop of the slings 360 can be wrapped around the tube 350 adjacent to the U-shaped concrete molded U-beam 360 and the end of the sling 365 can be further embedded into the concrete. A lifting point stiffer 370 can also be seen in FIG. 3 that can be used to lift the prefabricated wall panels 300 and floor foundations into place. Also shown in FIG. 3 is a C-type angle bracket 375 for horizontal section.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention as claimed.

What is claimed is:

1. A building apparatus for a residential or commercial building, the building apparatus comprises:

a prefabricated wall panel having a top side, a bottom side, a left side, and a right side, the prefabricated wall panel comprises:

a plurality of spaced-apart hollow tubes that extend between the top side and the bottom side of the prefabricated wall panel, each tube of the plurality of spaced-apart hollow tubes has a flange that extends perpendicularly from a periphery of the each tube, wherein the flange rests upon the top side of the prefabricated wall panel; and a horizontal beam mounted on the top side of the prefabricated wall panel, the horizontal beam has a top plate and a bottom plate, the bottom plate configured to be welded to the flange of each of the plurality of spaced-apart hollow tubes.

2. The building apparatus according to claim 1, wherein the flange is welded to the periphery of the each tube, the plurality of spaced-apart hollow tubes configured to receive a plurality of rebars.

3. The building apparatus according to claim 1, wherein the prefabricated wall panel further comprises:

a U-shape concrete beam that extends from the top side to the bottom side and is positioned at or near the left side or the right side of the prefabricated wall panel, an inner surface of the U-shape beam is exposed.

4. The building apparatus according to claim 3, wherein the prefabricated wall panel further comprises:

a plurality of rigid slings that extends through the U-shape concrete beam, the plurality of rigid slings are spaced apart at regular intervals along a length of the U-shape concrete beam.

5. The building apparatus according to claim 1, wherein the horizontal beam further comprises:

a plurality of bores that extend between the top plate and the bottom plate, wherein the plurality of bores are coaxially aligned to the plurality of spaced-apart hollow tubes.

6. The building apparatus according to claim 1, wherein the prefabricated wall panel further comprises:

a first concrete block;

a second concrete block;

an insulation panel, wherein the insulation panel is sandwiched between the first concrete block and the second concrete block; and a plurality of U-shape connectors that extends perpendicularly between the first concrete block and the second concrete block, the plurality of U-shape connectors are configured to immobilize the insulation panel mounted over the second concrete block.

7. The building structure according to claim 6, wherein the prefabricated wall panel further comprises:

a rebar mesh that extends throughout the first concrete block and the second concrete block.

8. The building structure according to claim 7, wherein the prefabricated wall panel further comprise:

a plurality of rebar to reinforce the first concrete block.

9. The building structure according to claim 8, wherein the prefabricated wall panel further comprises:

one or more electrical receptacles configured in the first concrete block; and one or more conduits that extend from the one or more electrical receptacles within the first concrete block and open at the top side, wherein the one or more conduits are configured to allow electrical wires to pass through.

10. The building structure according to claim 9, wherein the one or more electrical receptacles comprise light switches.

11. A building apparatus for a residential or commercial building, the building apparatus comprises:

a prefabricated wall panel having a top side, a bottom side, a left side, and a right side, the prefabricated wall panel comprises:

a plurality of spaced-apart hollow tubes that extend between the top side and the bottom side of the prefabricated wall panel, each tube of the plurality of spaced-apart hollow tubes has a flange that extends perpendicularly from a periphery of the each tube, wherein the flange rests upon the top side of the prefabricated wall panel;

a U-shape concrete beam that extends from the top side to the bottom side and is positioned at or near the left side or the right side of the prefabricated wall panel, an inner surface of the U-shape beam is exposed; and a plurality of rigid slings that extends through the U-shape concrete beam, the plurality of rigid slings are spaced apart at regular intervals along a length of the U-shape concrete beam.

12. The building apparatus according to claim 11, wherein the flange is welded to the periphery of the each tube, the plurality of spaced-apart hollow tubes configured to receive a plurality of rebars.

13. The building apparatus according to claim 11, wherein the prefabricated wall panel further comprises:

a horizontal beam mounted on the top side of the prefabricated wall panel, the horizontal beam has a top plate and a bottom plate, the bottom plate configured to be welded to the flange of each of the plurality of spaced-apart hollow tubes.

14. The building apparatus according to claim 11, wherein the prefabricated wall panel further comprises:

a first concrete block;

a second concrete block;

an insulation panel, wherein the insulation panel is sandwiched between the first concrete block and the second concrete block; and a plurality of U-shape connectors that extends perpendicularly between the first concrete block and the second concrete block, the plurality of U-shape connectors are configured to immobilize the insulation panel mounted over the second concrete block.

15. A building apparatus for a residential or commercial building, the building apparatus comprises:

a prefabricated wall panel having a top side, a bottom side, a left side, and a right side, the prefabricated wall panel comprises:

a plurality of spaced-apart hollow tubes that extend between the top side and the bottom side of the prefabricated wall panel, each tube of the plurality of spaced-apart hollow tubes has a flange that extends perpendicularly from a periphery of the each tube, wherein the flange rests upon the top side of the prefabricated wall panel;

a first concrete block;

a second concrete block;

an insulation panel, wherein the insulation panel is sandwiched between the first concrete block and the second concrete block; and a plurality of U-shape connectors that extend perpendicularly between the first concrete block and the second concrete block, the plurality of U-shape connectors are configured to immobilize the insulation panel mounted over the second concrete block.

16. The building apparatus according to claim 15, wherein the flange is welded to the periphery of the each tube, the plurality of spaced-apart hollow tubes configured to receive a plurality of rebars.

17. The building apparatus according to claim 15, wherein the prefabricated wall panel further comprises:

a U-shape concrete beam that extends from the top side to the bottom side and is positioned at or near the left side or the right side of the prefabricated wall panel, an inner surface of the U-shape beam is exposed.

18. The building apparatus according to claim 17, wherein the prefabricated wall panel further comprises:

a plurality of rigid slings that extends through the U-shape concrete beam, the plurality of rigid slings are spaced apart at regular intervals along a length of the U-shape concrete beam.

19. The building apparatus according to claim 15, wherein the building apparatus further comprises:

a horizontal beam mounted on the top side of the prefabricated wall panel, the horizontal beam has a top plate and a bottom plate, the bottom plate configured to be welded to the flange of each of the plurality of spaced-apart hollow tubes.

20. The building structure according to claim 15, wherein the prefabricated wall panel further comprises:

a rebar mesh that extends throughout the first concrete block and the second concrete block; and a plurality of rebar to reinforce the first concrete block.

* * * * *